US007837553B2

(12) United States Patent
Marks et al.

(10) Patent No.: US 7,837,553 B2
(45) Date of Patent: Nov. 23, 2010

(54) METHOD OF PLAY OF A SLOT MACHINE GAME WITH SEQUENTIAL ELIGIBILITY FOR A BONUS EVENT

(75) Inventors: Howard Mitchell Marks, Scarsdale, NY (US); Anthony Mark Singer, Ringwood, NJ (US); Daniel Mordecai Marks, Cold Spring, NY (US)

(73) Assignee: PTT LLC, Mahwah, NJ (US)

( * ) Notice: Subject to any disclaimer, the term of this patent is extended or adjusted under 35 U.S.C. 154(b) by 1196 days.

(21) Appl. No.: 11/455,292

(22) Filed: Jun. 15, 2006

(65) Prior Publication Data

US 2006/0247017 A1 Nov. 2, 2006

Related U.S. Application Data

(63) Continuation-in-part of application No. 10/438,325, filed on May 15, 2003, now Pat. No. 7,278,914, which is a continuation-in-part of application No. 09/939,787, filed on Aug. 28, 2001, now Pat. No. 6,960,133, and a continuation-in-part of application No. 10/105,942, filed on Mar. 26, 2002, now Pat. No. 6,935,947, which is a continuation-in-part of application No. 09/432,602, filed on Nov. 3, 1999, now abandoned, which is a continuation-in-part of application No. 09/234,098, filed on Jan. 19, 1999, now Pat. No. 6,371,851, which is a continuation of application No. PCT/US98/10383, filed on May 21, 1998, said application No. 10/438,325 is a continuation-in-part of application No. 10/105,942, filed on Mar. 26, 2002, and a continuation-in-part of application No. 09/613,727, filed on Jul. 11, 2000, now Pat. No. 6,604,998.

(60) Provisional application No. 60/228,472, filed on Aug. 28, 2000, provisional application No. 60/047,493, filed on May 23, 1997, provisional application No. 60/289,633, filed on May 9, 2001, provisional application No. 60/164,583, filed on Nov. 10, 1999, provisional application No. 60/380,485, filed on May 15, 2002, provisional application No. 60/412,012, filed on Sep. 20, 2002, provisional application No. 60/445,769, filed on Feb. 10, 2003.

(51) Int. Cl.
*A63F 9/24* (2006.01)

(52) U.S. Cl. ..... 463/25; 463/16; 463/24

(58) Field of Classification Search ..... 463/10–25
See application file for complete search history.

(56) References Cited

U.S. PATENT DOCUMENTS

| | | | | |
|---|---|---|---|---|
| 4,695,053 | A * | 9/1987 | Vazquez et al. | 463/18 |
| 5,393,061 | A * | 2/1995 | Manship et al. | 463/20 |
| 6,089,977 | A * | 7/2000 | Bennett | 463/20 |
| 6,419,579 | B1 * | 7/2002 | Bennett | 463/20 |
| 2004/0127280 | A1 * | 7/2004 | Moody | 463/20 |
| 2007/0298862 | A1 * | 12/2007 | Kidneigh | 463/20 |
| 2010/0004049 | A1 * | 1/2010 | Ching et al. | 463/20 |
| 2010/0062827 | A1 * | 3/2010 | Hoffman et al. | 463/20 |

* cited by examiner

*Primary Examiner*—Pierre E Elisca

(57) ABSTRACT

The present invention provides methods for a player to become sequentially eligible for a bonus event based upon the appearance of predetermined symbols in designated locations of the symbol matrix during the play of one or more rounds of a slot machine game. In a preferred embodiment of the present invention, a specific predetermined symbol must appear in each of the columns comprising the symbol matrix during the play of one or more free spins of the slot machine game to initiate a bonus event.

8 Claims, 8 Drawing Sheets

METHOD OF PLAY OF A SLOT MACHINE GAME WITH SEQUENTIAL ELIGIBILITY FOR A BONUS EVENT

PRIORITY CLAIMS AND RELATED APPLICATIONS

This application is a continuation-in-part of U.S. application Ser. No. 10/438,325, filed May 15, 2003, which is a continuation-in-part of U.S. application Ser. No. 09/939,787, filed Aug. 28, 2001, now U.S. Pat. No. 6,960,133, which claims priority from U.S. Provisional Application No. 60/228,472, filed Aug. 28, 2000. This application is also a continuation-in-part of U.S. application Ser. No. 10/438,325, filed May 15, 2003, which is a continuation-in-part of U.S. application Ser. No. 10/105,942, filed Mar. 26, 2002, now U.S. Pat. No. 6,935,947, which is a continuation-in-part of U.S. application Ser. No. 09/432,602, filed Nov. 3, 1999, which is a continuation-in-part of U.S. application Ser. No. 09/234,098, filed Jan. 19, 1999, now U.S. Pat. No. 6,371,851, which is a continuation of International Application No. PCT/US98/10373, filed May 21, 1998, which in turn claims priority from U.S. Provisional Application No. 60/047,493, filed May 23, 1997. U.S. application Ser. No. 10/105,942 also claims priority from U.S. Provisional Application No. 60/289,633, filed on May 9, 2001. This application is a continuation-in-part of U.S. application Ser. No. 10/438,325, filed May 15, 2003, which is also a continuation-in-part of U.S. application Ser. No. 09/613,727, filed Jul. 11, 2000, now U.S. Pat. No. 6,604,998, which claims priority from U.S. Provisional Application No. 60/164,583, filed Nov. 10, 1999. This application also is a continuation-in-part of U.S. application Ser. No. 10/438,325, filed May 15, 2003, which claims priority from U.S. Provisional Application Nos. 60/380,485, filed May 15, 2002, 60/412,012, filed Sep. 20, 2002, and 60/445,769, filed Feb. 10, 2003. All of these applications are incorporated herein by reference.

COPYRIGHT NOTICE

A portion of the disclosure of this patent document contains or may contain material subject to copyright protection. The copyright owner has no objection to the photocopy reproduction of the patent document or the patent disclosure in exactly the form it appears in the Patent and Trademark Office patent file or records, but otherwise reserves all copyright rights.

FIELD OF THE INVENTION

In general, the present invention relates to methods of initiating a bonus event in a slot machine game. More specifically, the present invention provides methods for becoming sequentially eligible to participate in a bonus event during the play of a slot machine game.

BACKGROUND OF THE INVENTION

To play a conventional slot machine, the player deposits money into the machine, sets the wager, and spins the reels. When the reels stop spinning, the player collects credits for winning symbol combinations displayed on the reels, if any, according to a predetermined pay schedule.

While the appearance of conventional slot machines may change from one theme, such as space aliens, to another, such as farm animals, the underlying methods of play—setting the wager, spinning the reels, collecting awards—remain the same from machine to machine.

The many similarities of conventional slot machines frustrate players, casinos, and manufacturers. Players tire of games using the same methods of play; casinos cannot distinguish their games offerings from other casinos; and manufacturers cannot distinguish their products from other manufacturers.

New methods of playing slot machines, therefore, are required to provide players, casinos, and manufacturers with uniquely entertaining slot machine games, including new methods of initiating bonus events, as taught by the present invention.

SUMMARY OF THE INVENTION

The present invention provides methods for a player to become sequentially eligible for a bonus event based upon the appearance of predetermined symbols in designated locations of the symbol matrix during the play of one or more rounds of a slot machine game.

In a preferred embodiment of the present invention, a specific predetermined symbol must appear in each of the columns comprising the symbol matrix during the play of one or more free spins of the slot machine game to initiate a bonus event, as described in more detail below:

The preferred embodiment only utilizes one predetermined symbol, such as a symbol marked: "Bonus." In an alternative embodiment, any number of predetermined symbols may be used in the slot machine game. For example, the game may use any of three pre-determined symbols—"Bonus 1", "Bonus 2", and "Bonus 3".

The preferred embodiment requires the appearance of a predetermined symbol in each column of the symbol matrix. In an alternative embodiment, a predetermined symbol must appear in any designated location of the symbol matrix. For example, a predetermined symbol may be required to appear in each row of the symbol matrix.

The preferred embodiment requires at least one appearance of the predetermined symbol in each column of the symbol matrix. In another embodiment, a predetermined symbol must appear more than one time in the designated locations. For example, a predetermined symbol must appear at least twice in each designated location of the symbol matrix.

The preferred embodiment requires the appearance of the same predetermined symbol in each column of the symbol matrix to make the player eligible for the bonus event. In an alternative embodiment, different predetermined symbols must appear in each designated location of the symbol matrix. For example, predetermined symbol A must appear in designated location 1. The appearance of predetermined symbol A in any other location does not count towards sequential eligibility for the bonus event.

The preferred embodiment indicates the appearance of a predetermined symbol by highlighting the column in which the predetermined symbol appeared. In an alternative embodiment, the appearance of a predetermined symbol may be indicated in any manner or not at all. For example, the appearance of a predetermined symbol is indicated by blinking the predetermined symbol.

The preferred embodiment maintains the same predetermined symbol from game to game. In alternative embodiment, the predetermined symbol may change, as determined by the player, the game, and/or at random. For example, prior to each spin the player may select a predetermined symbol from a plurality of available symbols.

The preferred embodiment maintains the same predetermined column locations in the symbol matrix from game to game. In an alternative embodiment, the designated locations in the symbol matrix may change, as determined by the player, game, and/or at random. For example, the designated locations may vary from columns to rows of the symbol matrix.

The preferred embodiment issues an award value of one time the total bet for each time a predetermined symbol appear in the symbol matrix. In another embodiment, the appearance of a predetermined symbol generates any award or no award at all. For example, the appearance of a predetermined symbol generates an award of five times the total bet.

In the preferred embodiment, the player becomes eligible for a bonus event once the predetermined symbol appears in each column of the symbol matrix, in any order of appearance. In an alternative embodiment, the player may become eligible once predetermined symbols appear in designated locations, in a particular order of appearance. For example, a predetermined symbol must appear in each of the columns of the symbol matrix, in the predetermined order of leftmost column to rightmost column.

In the preferred embodiment, the bonus event comprises a credit award. In an alternative embodiment, any bonus event may occur, such as free spins, a prize, a service, and/or any other award. For example, the bonus event may comprise a progressive cash value award.

In the preferred embodiment, the bonus event calculates the value of the credit award as a multiple of the total wager. In an alternative embodiment, the value of the bonus event may be calculated using any method. For example, the value of the bonus event may be calculated as a multiple of the line bet.

In the preferred embodiment, the predetermined symbols only appear in the symbol matrix during free spins. In an alternative embodiment, the predetermined symbols may appear at any point of the game, including the primary game and/or secondary features. For example, predetermined symbols may only appear in symbol matrix during the base game.

In the preferred embodiment, the player may become sequentially eligible for the bonus event with any wager. In an alternative embodiment, the player must place a specific wager amount or place an additional side-wager to become eligible for the bonus event. For example, a player must wager 5 additional credits for each credit wagered upon the bet per line to become sequentially eligible for a bonus event.

BRIEF DESCRIPTION OF THE DRAWINGS

The accompanying figures illustrate the base game and free spin round of the preferred embodiment of the present invention.

DESCRIPTION OF A PREFERRED EMBODIMENT

Figure 1:
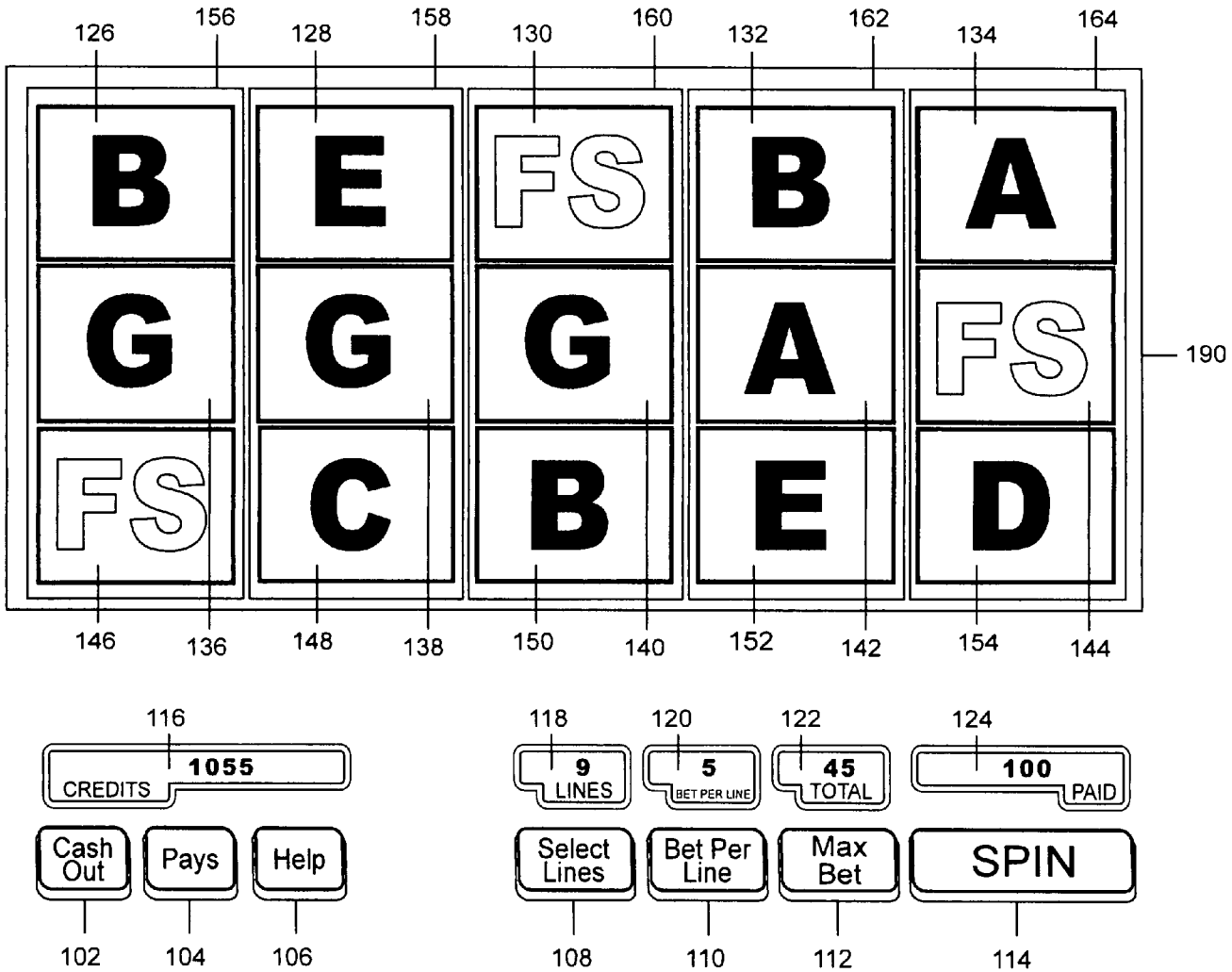
FIG. 1 shows a representative base game screen initializing a free spin round.

To play the preferred embodiment of the present invention, the player plays a base game during which the player initializes credits, sets the wager, spins the reels, collects awards for wining symbol combinations, and triggers a secondary game with free spins, as detailed below with reference to FIG. 1.

Initialize Credits. In FIG. 1, the player initializes credits by depositing money in the form of coins, gaming tokens or paper currency into a coin head (not shown) or bill acceptor (not shown). Coins and gaming tokens are collected in a reservoir (not shown) inside the gaming machine; paper currency is collected in the bill acceptor (not shown) inside the gaming machine.

If the coins, gaming tokens or paper currency are validated as authentic, the player accrues the appropriate number of playing credits on the Credit meter 116. More credits may be initialized, if necessary, by additional deposits. Alternatively, any method of initializing credits may be used including debit cards, credit cards, or other form of electronic funds transfer.

Set the Wager. In FIG. 1, the player sets the wager by selecting pay lines and setting the bet per pay line. The wager is calculated by multiplying the number of selected pay lines by the bet per pay line. For example, the player may wager five credits on each of nine pay lines for a total bet of forty-five credits. The total bet amount is displayed on the Total Bet meter 122.

To select pay lines, the player uses the Select Pay Lines button 108 and views the number of selected pay lines on the Select Pay Lines meter 118. The player uses the Select Pay Lines button to select pay lines in a predetermined order. For example, the first pay line selected is always pay line 1, second pay line selected is always pay line 2, etc. Alternatively, fewer or greater than nine pay lines may be used with any order of pay line activation.

To set the bet per pay line, the player uses the Bet Per Pay Line button 110 and views the amount bet per pay line on the Bet Per Pay Line meter 120. The same amount is wagered on each pay line. For example, up to five credits may be wagered on each pay line. Alternatively, wagers of any amount may be placed on a pay line, with the same or different amount wagered on each pay line.

To automatically select all available paylines and wager the maximum amount on each of the pay lines, the player may use the Bet Max button 112. Alternatively, any wager may be assigned a button. Further, the Bet Max button also acts a spin button to rearrange the symbols displayed in the symbol matrix 190.

In FIG. 1, the player has used the Select Lines button 108 to select 9 pay lines and used the Bet Per Line button 110 to wager 5 credits upon each of the selected paylines. The 9 lines selected appear in the Lines meter 118. The 5 credits wagered on each selected payline appear in the Bet Per Line meter 120. The total wager amount of 45 credits appears in the Total Wager meter 124.

Spin the Reels. In FIG. 1, the player uses the Spin button 114 to randomly rearrange the symbols displayed in the symbol matrix 190. The symbol matrix 190 contains three symbol positions in each of the five columns 156-164 for a total of fifteen symbol positions 126-154. Each symbol position 126-154 is associated with a reel strip. Alternatively, any number of reel strips may be used to display symbols in symbol positions 126-154 of the symbol matrix 190. The reel strips associated with each of the five columns 156-164 spin and randomly stop one at-a-time until all of the columns 156-164 have stopped and the symbols are revealed. Alternatively, any size symbol matrix may be used and any method may be used to rearrange symbols in the symbol matrix.

Winning Symbol Combinations. Winning symbol combinations are formed by two or more, same, adjacent symbols, starting from the leftmost position of a pay line. A predetermined pay schedule lists the award for each winning symbol combination. Any number of winning symbol combinations may be defined, with any amount assigned to each award. For example, the pay schedule may define four "A" symbols as a winning symbol combination with an award of 10× the bet per line. The player may view the pay schedule by using the Pays button 104.

In FIG. 1, a winning G-G-G symbol combination at 136, 138, 140 appears on a payline and generates a 20× line bet award, or 100 credits, as shown on the Paid meter at 124. The number of credits in the credit pool increases to 1055, as displayed on Credit Meter 116

Trigger Event. The base game uses a scatter symbol combination as the trigger event—three "FS" symbols anywhere on the slot reels—to initiate a secondary game with free spins. Alternatively, the secondary game may be triggered in any suitable manner, such as a symbol combination, amount wagered, and/or random intervals.

Trigger symbols appearing in the base game neither help form winning symbol combinations nor affect value of payline awards. Alternatively, trigger symbols may act as wildcard symbols to help form winning symbol combinations and/or affect the type or value of winning symbol combination awards.

In FIG. 1, the three trigger symbols appearing at 146, 130, 144 in symbol matrix 190 initiate the free spin bonus round with 6 free spins. Immediately upon triggering the secondary game, all of the free spins are played, as described in the Secondary Game with Free Spins section below.

Secondary Game with Free Spins. In the secondary game, the player collects awards for wining symbol combinations and collects additional awards for the appearance of a predetermined symbol in the columns of the symbol matrix. In addition, the player collects a special event for the appearance of the predetermined symbol in each column, as detailed below with reference to FIGS. 2 to 8.

Figure 2:
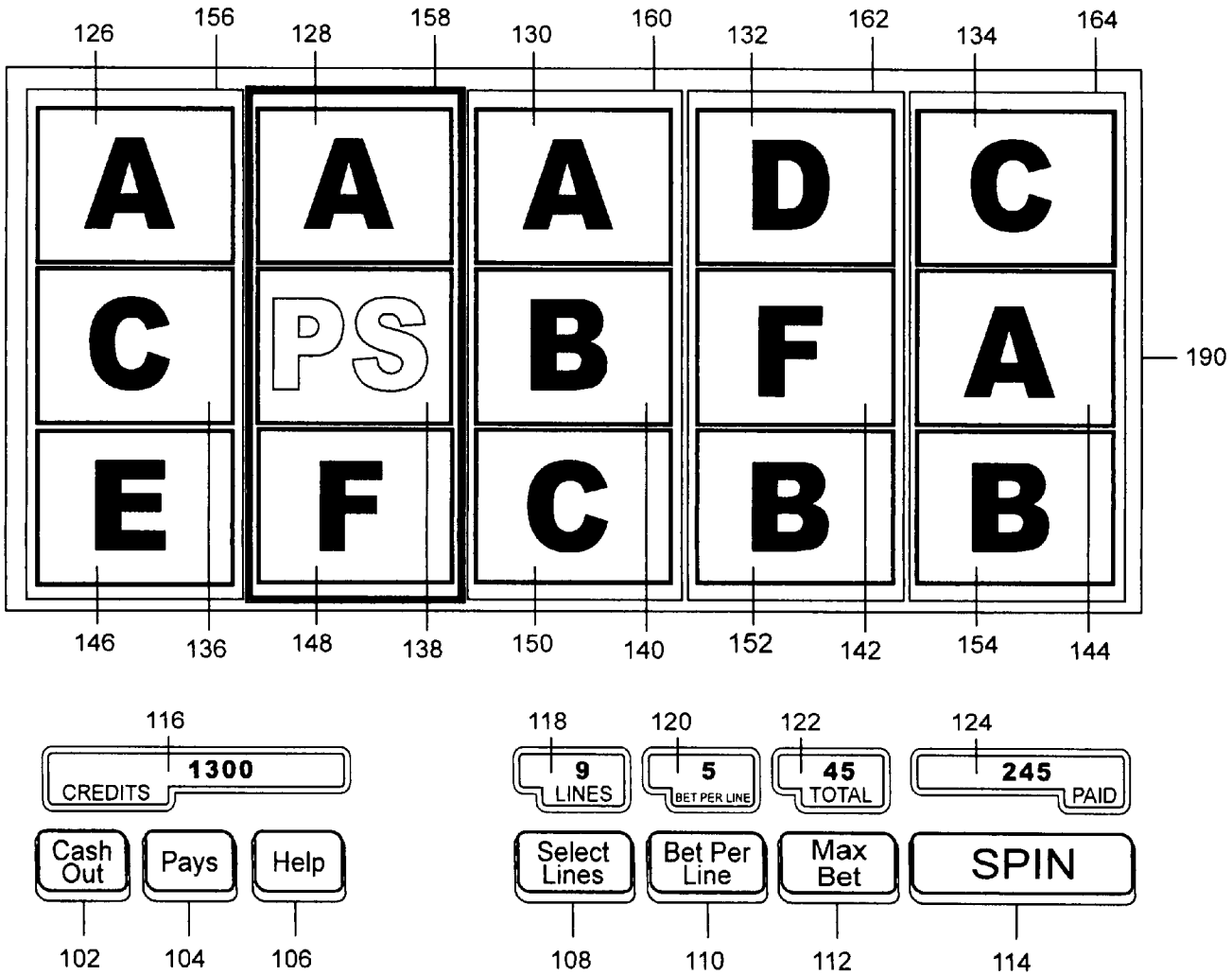
FIG. 2 shows a representative free spin game screen with a predetermined symbol in the second column of the symbol matrix.

First Free Spin. In FIG. 2, the first free spin displays a winning A-A-A symbol combination 126, 128, 130 on a payline and a predetermined symbol ("PS") in the second column 158 from the left of the symbol matrix 190. The winning A-A-A symbol combination results in an award of 40× line bet, or 200 credits. The PS symbol results in a 1× total bet award, or 45 credits. The total award of 245 credits is displayed on the Paid meter 124. The number of credits in the credit pool increases to 1300, as displayed on Credit Meter 116. Further, the column 158 in which the PS symbol appears is highlighted.

Figure 3:
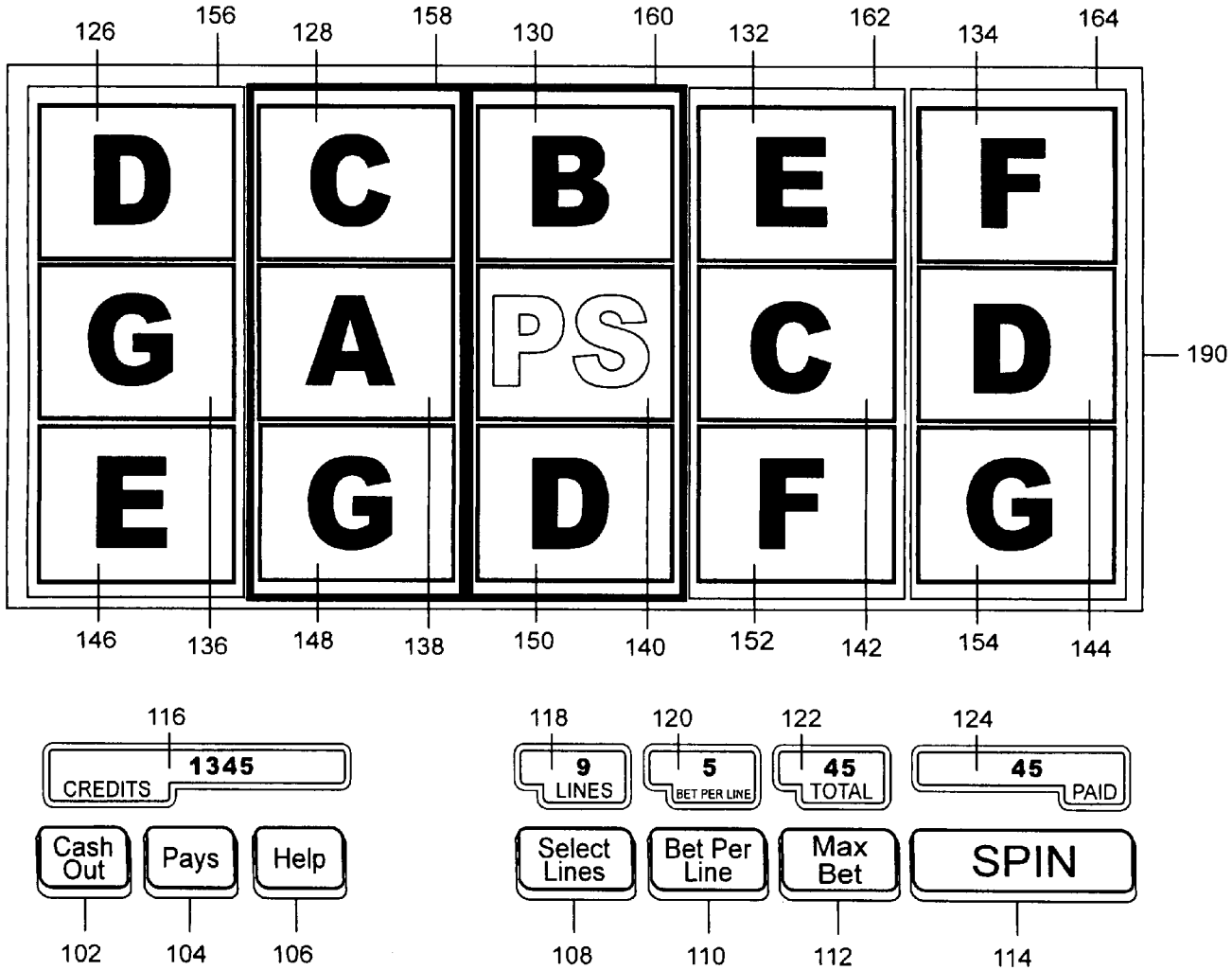
FIG. 3 shows a representative free spin game screen with a predetermined symbol in the third column of the symbol matrix.

Second Free Spin. In FIG. 3, the second free spin displays a predetermined symbol ("PS") in the third column 160 from the left of the symbol matrix 190. The PS symbol results in a 1× total bet award, or 45 credits. The total award of 45 credits is displayed on the Paid meter 124. The number of credits in the credit pool increases to 1345, as displayed on Credit Meter 116. Further, the column 160 in which the PS symbol appears is highlighted.

Figure 4:
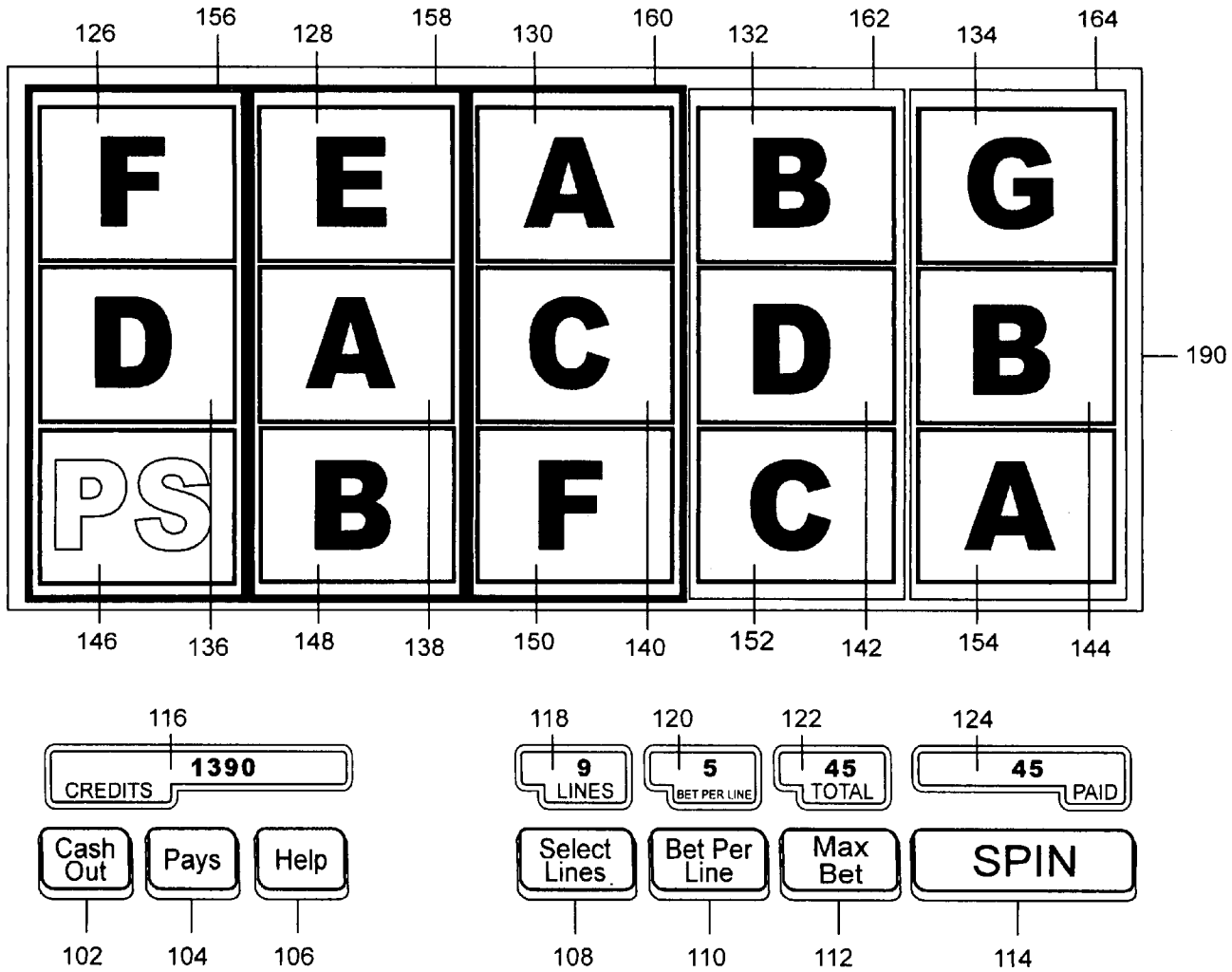
FIG. 4 shows a representative free spin game screen with a predetermined symbol in the first column of the symbol matrix.

Third Free Spin. In FIG. 4, the third free spin displays a predetermined symbol ("PS") in the first column 156 from the left of the symbol matrix 190. The PS symbol results in a 1× total bet award, or 45 credits. The total award of 45 credits is displayed on the Paid meter 124. The number of credits in the credit pool increases to 1390, as displayed on Credit Meter 116. Further, the column 156 in which the PS symbol appears is highlighted.

Figure 5:
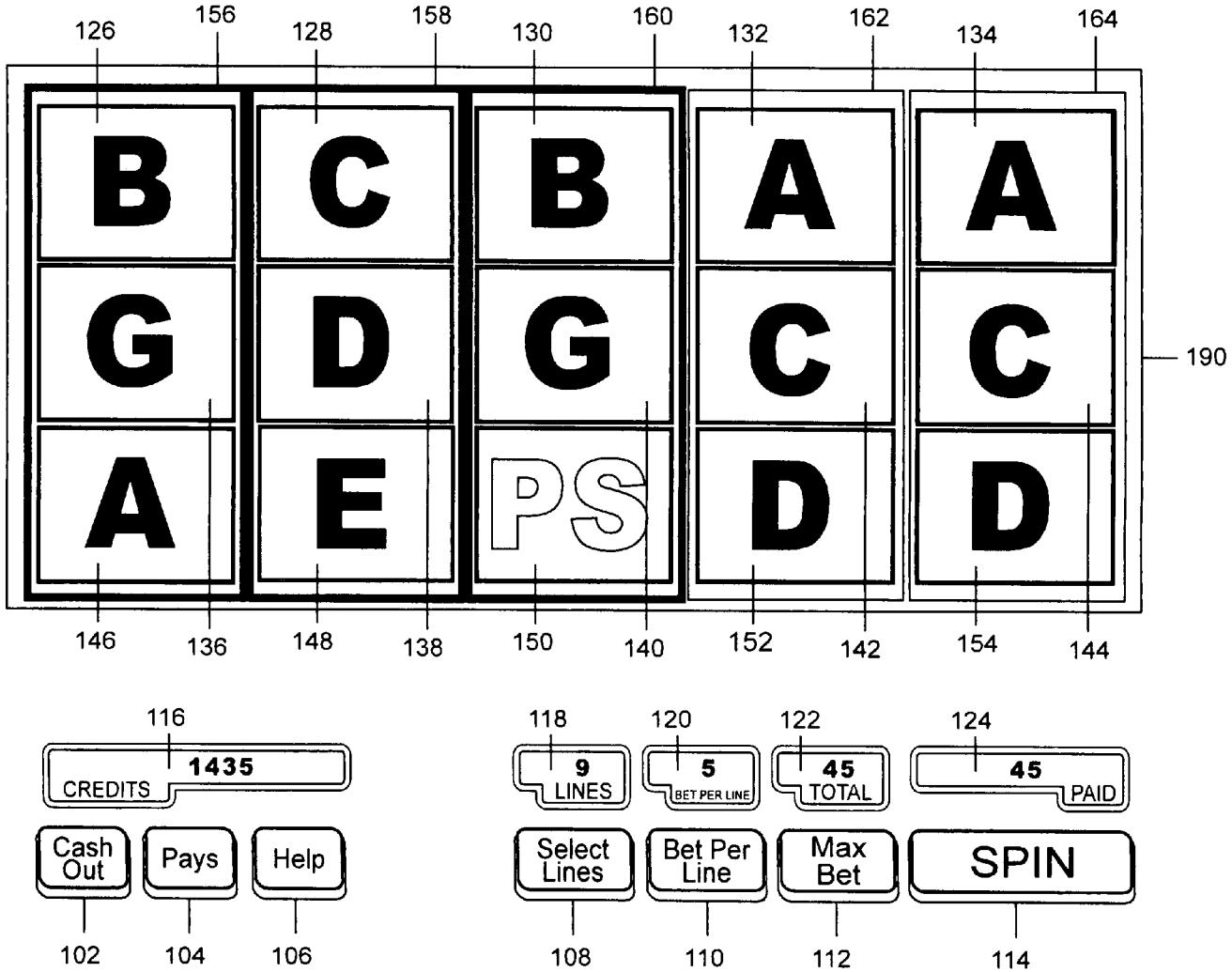
FIG. 5 shows a representative free spin game screen with a predetermined symbol in the third column of the symbol matrix.

Fourth Free Spin. In FIG. 5, the fourth free spin displays a predetermined symbol ("PS") again in the third column 160 from the left of the symbol matrix 190. The PS symbol results in a 1× total bet award, or 45 credits. The total award of 45 credits is displayed on the Paid meter 124. The number of credits in the credit pool increases to 1435, as displayed on Credit Meter 116. The column 160 in which the PS symbol appears remains highlighted.

Any appearance of a PS symbol in a column of the symbol matrix 190, including first, second, and subsequent appearances, results in a 1× total bet award. Alternatively, the value of a predetermined symbol may vary from one appearance to the next. For example, the value of a predetermined symbol may increase by 1× total bet for each subsequent appearance in the same column.

Repeated appearances of a PS symbol in the same column of the symbol matrix 190 do not affect the sequential eligibility for a bonus event. Alternatively, a second (or even number) appearance of a predetermined symbol in a column may de-activate the column, remove the highlighting, and require that the predetermined symbol appear a third (or odd number) in that column to re-activate and re-highlight the column.

Figure 6:
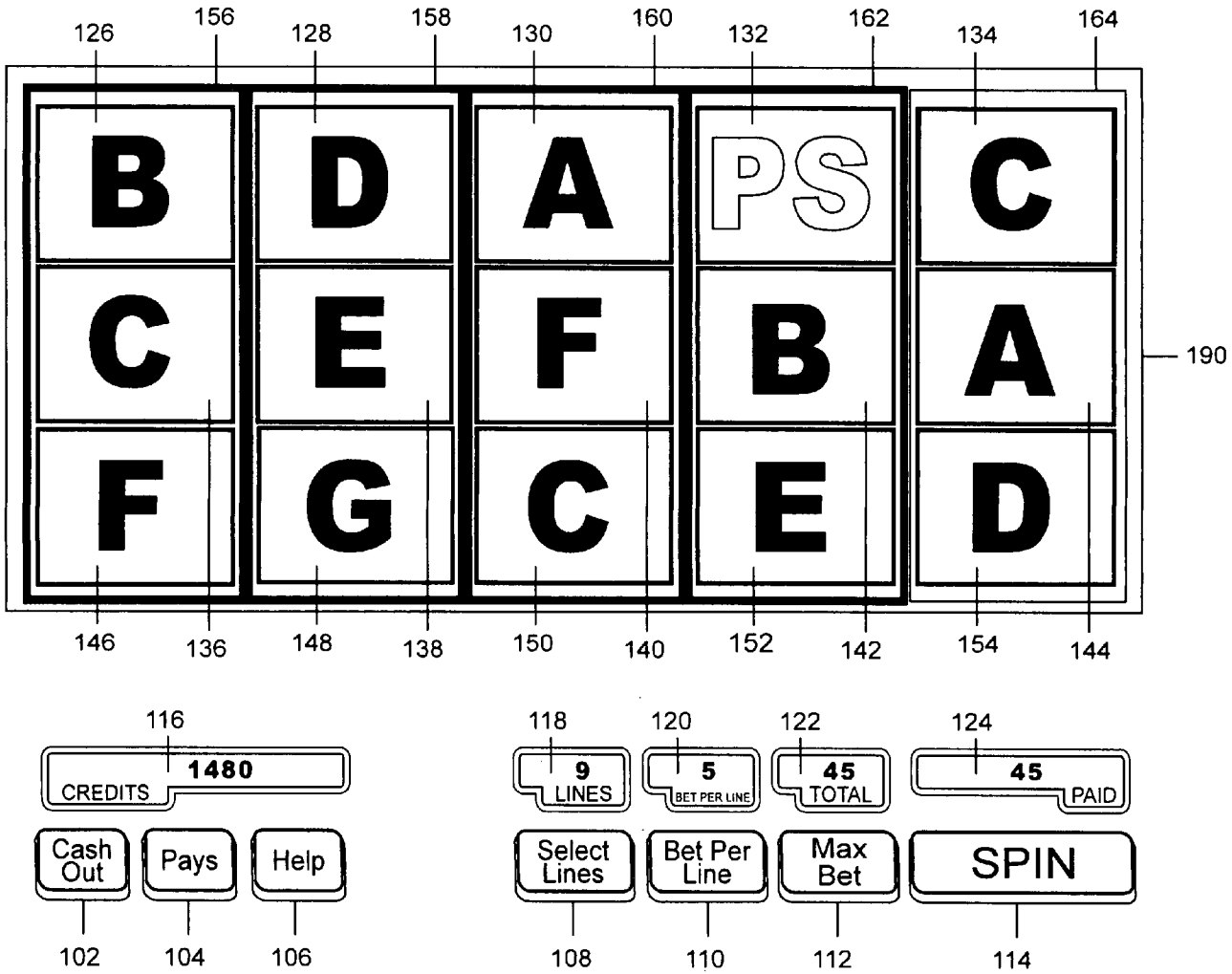
FIG. 6 shows a representative free spin game screen with a predetermined symbol in the fourth column of the symbol matrix.

Fifth Free Spin. In FIG. 6, the fifth free spin displays a predetermined symbol ("PS") in the fourth column 162 from the left of the symbol matrix 190. The PS symbol results in a 1× total bet award, or 45 credits. The total award of 45 credits is displayed on the Paid meter 124. The number of credits in the credit pool increases to 1480, as displayed on Credit Meter 116. Further, the column 162 in which the PS symbol appears is highlighted.

Figure 7:
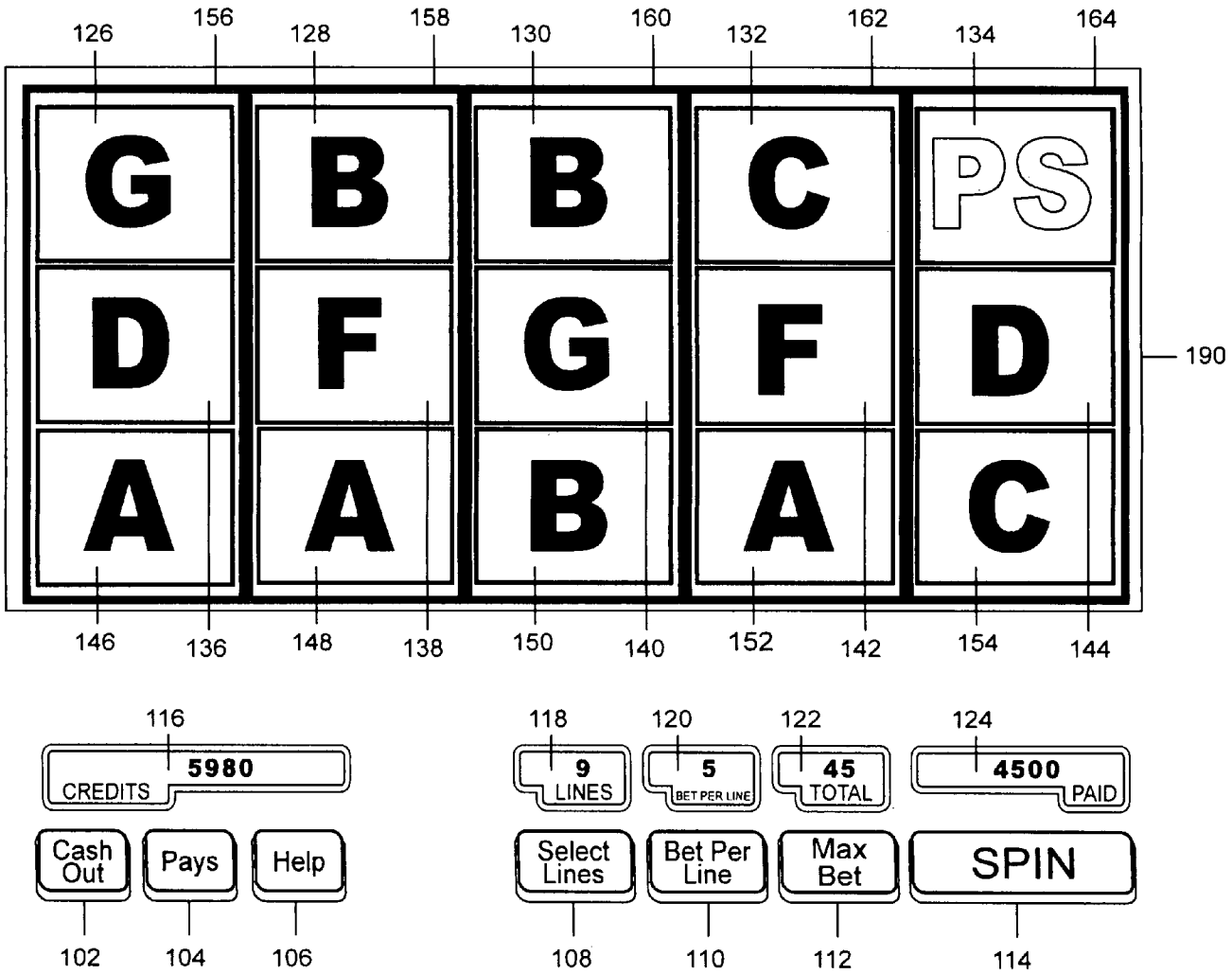
FIG. 7 shows a representative free spin game screen with a predetermined symbol in the fifth column of the symbol matrix.

Sixth Free Spin. In FIG. 7, the sixth and final free spin displays a predetermined symbol ("PS") in the fifth column 164 from the left of the symbol matrix 190. With the appearance of the PS symbol in all five of the columns of the symbol matrix, the game issues the bonus event award of 100× total bet award, or 4500 credits. The total award of 4500 credits is displayed on the Paid meter 124. The number of credits in the credit pool increases to 5980, as displayed on Credit Meter 116. Further, the column 164 in which the PS symbol appears is highlighted.

Figure 8:
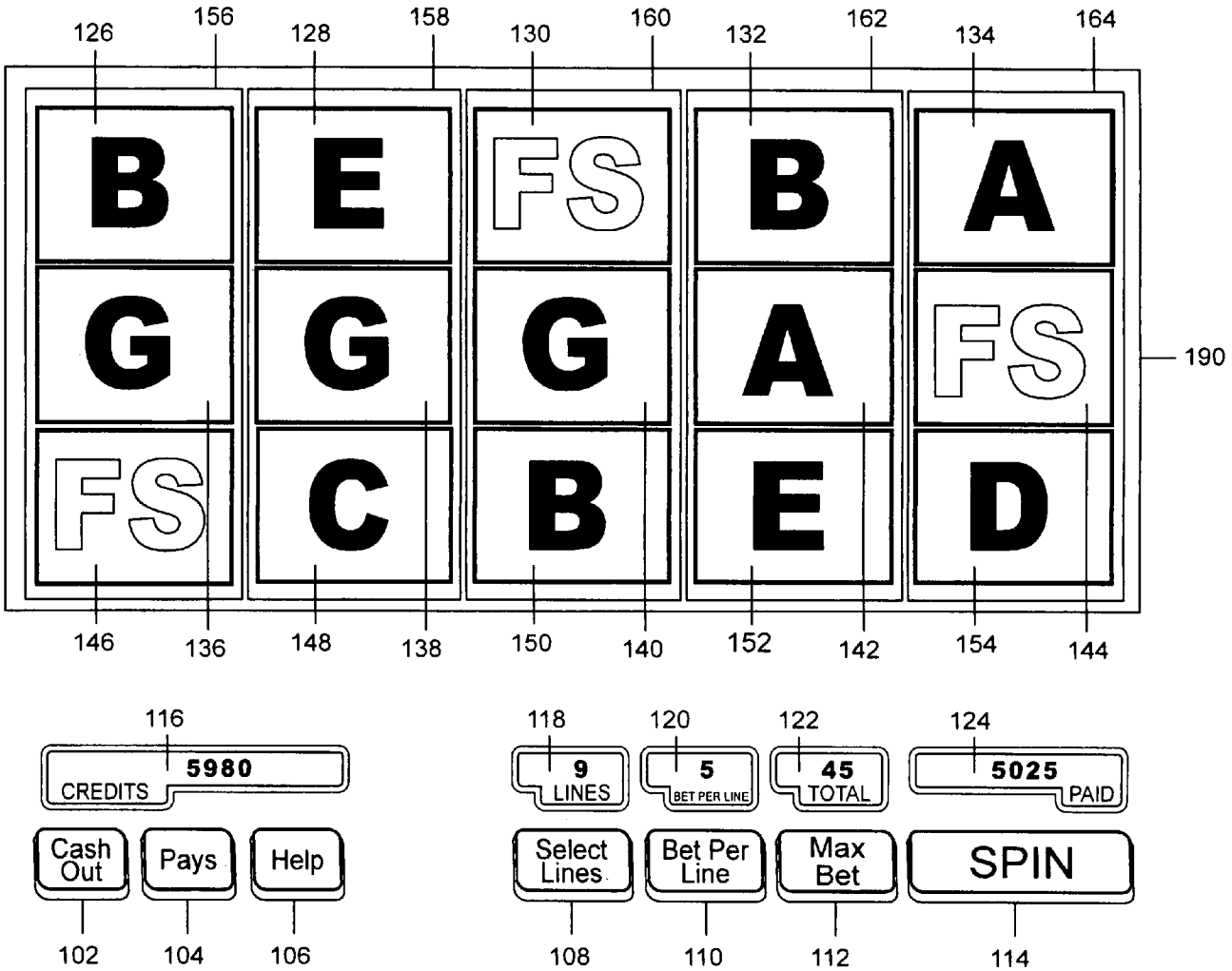
FIG. 8 shows a representative base game screen after completion of the free spin round.

Following the completion of all free spins, the secondary game ends, all of the column highlights disappear and player returns to a base game screen displaying the triggering spin, as shown in FIG. 8. The 5025 cumulative credits awarded during the trigger spin, 100, and during the free spins, 4925, are displayed on the Paid meter 124. The 5980 credits in the credit pool are displayed on Credit meter 116.

As long as the player has credits on the Credit meter 116, the player may continue to play the game. Between each game, the player may change the number of paylines selected and the amount wagered on each selected payline, as described above. The player may also collect the balance of credits by pressing the Cash Out button 102. In addition, the player may press the Help button 106 to view the rules of the game.

SCOPE & SPIRIT OF THE PRESENT INVENTION

The many features and advantages of the present invention are apparent from the descriptions of the preferred and alternative embodiments. The present invention, however, is not limited to these particular embodiments, as the invention is capable of being practiced and carried out in various ways. For example, new features may be added to an existing embodiment or features from two or more embodiments may be combined to produce a new embodiment. Further, features mentioned in any embodiment may be interchanged with similar features not mentioned that perform the same or similar functions. And, finally, the phraseology and terminology used to explain the embodiments are only descriptive and should not be regarded as limiting. The claims, therefore, seek to cover all features and advantages that fall within the true spirit and scope of the present invention.

We claim:

1. A method of operating an electronic gaming device via a processor, comprising:

the processor operable to display a game using a symbol matrix formed by at least one row intersecting with a plurality of columns to form symbol locations, wherein said symbol locations display a plurality of symbols;

the processor operable to define a plurality of said symbol locations as designated symbol locations for a plurality of game iterations, the processor operable to accept a wager from a player to participate in said game and for each game iteration a) the processor operable to randomly rearrange the plurality of symbols in said symbol matrix;

b) the processor operable to display said rearranged symbols in said symbol locations c) the processor operable to provide awards for any winning outcomes for each game iteration;

d) the processor operable to determine if a predetermined symbol appears in any designated symbol location and indicating, for the remaining iterations, the designated symbol locations if said symbol is present or previously present;

the processor operable to initiate a bonus event upon a predetermined number of designated locations being indicated in steps a-d.

2. A method of claim 1 in which the designated symbol locations includes all of the locations in a column of the symbol matrix.

3. A method of claim 1 in which indicating the designated symbol location is a visual indication to player.

4. A method of claim 1 in which the game also issues an award for each appearance of the predetermined symbol in the symbol matrix.

5. A method of claim 1 in which the game initiates the bonus event upon the appearance of the predetermined symbol in each of the designated locations.

6. A method of claim 1 in which the bonus event is a credit award.

7. A method of claim 1 in which a trigger event during a base game triggers a secondary game in which the game repeats step a through d for a fixed number of free rounds until all free rounds complete or the bonus event initiates.

8. A method of operating an electronic gaming device via a processor, comprising:

the processor operable to display a game using a symbol matrix formed by three rows intersecting with five columns wherein said matrix comprises fifteen symbol locations, wherein said symbol locations display a plurality of symbols the processor operable to define each of the five columns as designated locations, the processor operable to accept a wager from a player to participate in a base game;

the processor operable to randomly rearrange the plurality of symbols;

the processor operable to randomly display the rearranged symbols;

the processor operable to determine if a triggering event occurs in the base game and if said triggering event occurs, the processor is operable to start a secondary game for a plurality of game iterations comprising:

i. randomly rearranging a plurality of symbols;

ii. displaying the rearranged symbols;

iii. determining if a predetermined symbol appears in one of the columns;

iv. highlighting the column in which the predetermined symbol appears;

v. issuing an award for each predetermined symbol appearing in a column;

vi. issuing an additional award if the predetermined symbol appears in each designated location; and vii. returning to the base game upon completion of plurality of game iterations or upon issuance of the award at step (vi).

* * * * *